US010614708B1

(12) United States Patent
Cooper et al.

(10) Patent No.: US 10,614,708 B1
(45) Date of Patent: Apr. 7, 2020

(54) TRAIN DETECTION SYSTEM FOR A RAILWAY TRACK SECTION, ASSOCIATED RAILWAY TRACK SECTION, AND ASSOCIATED METHOD FOR DETECTING PRESENCE OF A RAILWAY VEHICLE ON A TRACK SECTION

(71) Applicant: ALSTOM Transport Technologies, Saint-Ouen (FR)

(72) Inventors: Jared Cooper, Melbourne, FL (US); Nicholas Nagrodsky, Melbourne, FL (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 0 days.

(21) Appl. No.: 16/259,243

(22) Filed: Jan. 28, 2019

(51) Int. Cl.

| | |
|---|---|
| ***G08G 1/042*** | (2006.01) |
| ***B61L 23/16*** | (2006.01) |
| ***B61L 23/04*** | (2006.01) |
| ***B61L 27/00*** | (2006.01) |
| ***B61L 1/18*** | (2006.01) |

(52) U.S. Cl.
CPC ..... *G08G 1/042* (2013.01); *B61L 23/047* (2013.01); *B61L 23/168* (2013.01); *B61L 1/188* (2013.01); *B61L 23/165* (2013.01); *B61L 27/0094* (2013.01)

(58) Field of Classification Search
CPC ..... B61L 1/187; B61L 1/188; B61L 1/164; B61L 1/06; B61L 1/165; B61L 23/04; B61L 23/044; B61L 23/041; B61L 25/021; B61L 25/025; B61L 23/168; B61L 23/047; B61L 23/165; B61L 27/0094; G08G 1/042
See application file for complete search history.

(56) References Cited

U.S. PATENT DOCUMENTS

| | | | | |
|---|---|---|---|---|
| 3,609,676 A * | 9/1971 | Jauquet | B61L 3/225 246/187 B |
| 3,683,176 A * | 8/1972 | Crofts | B61L 1/187 246/40 |
| 4,807,160 A * | 2/1989 | Nozaki | G01R 31/021 324/503 |
| 5,026,141 A * | 6/1991 | Griffiths | G01B 11/18 250/227.14 |

(Continued)

FOREIGN PATENT DOCUMENTS

| | | |
|---|---|---|
| DE | 3815152 A1 | 11/1989 |
| EP | 1128171 A1 | 8/2001 |

(Continued)

*Primary Examiner* — Hoi C Lau
(74) *Attorney, Agent, or Firm* — Pearne & Gordon LLP

(57) ABSTRACT

A train detection system for a railway track section placed on a track bed, the track section having two rails, the train detection system comprising at least one cable, the cable being placed across the two rails, a transmitter connected to the cable and configured to emit an emitted signal into the at least one cable, a receiver connected to the cable and configured to receive a received signal related to the emitted signal having passed through the cable, and capable of determining, according to the received signal, between an unoccupied state where no railway vehicle is present on the track section, and an occupied state where the track section is occupied by a railway vehicle. The cable is buried under the track bed.

15 Claims, 1 Drawing Sheet

(56) References Cited

U.S. PATENT DOCUMENTS

| | | | | |
|---|---|---|---|---|
| 5,330,136 | A * | 7/1994 | Colbaugh | B61L 1/06 246/122 R |
| 6,586,671 | B1 * | 7/2003 | Kelley | H02G 9/10 174/38 |
| 8,861,973 | B2 * | 10/2014 | Tam | B61L 23/041 398/140 |
| 2011/0251809 | A1 * | 10/2011 | Stollenwerk | B61L 1/187 702/65 |
| 2012/0138752 | A1 * | 6/2012 | Carlson | B61L 1/164 246/126 |
| 2014/0362668 | A1 * | 12/2014 | McEwen-King | G01H 9/004 367/118 |
| 2015/0000415 | A1 * | 1/2015 | Kelley | B61L 5/12 73/649 |
| 2015/0013465 | A1 * | 1/2015 | Godfrey | B61L 23/044 73/655 |
| 2016/0221591 | A1 * | 8/2016 | Kuehbandner | B61L 1/165 |
| 2016/0356661 | A1 * | 12/2016 | Glueck | B61K 9/08 |
| 2018/0018888 | A1 * | 1/2018 | Townsend | B60Q 9/008 |
| 2018/0281830 | A1 * | 10/2018 | Lanteri | B61L 1/188 |
| 2018/0354534 | A1 * | 12/2018 | Cole | B61L 25/021 |
| 2019/0225250 | A1 * | 7/2019 | Esprey | B61L 1/06 |
| 2019/0232990 | A1 * | 8/2019 | Moennich | B61L 25/025 |

FOREIGN PATENT DOCUMENTS

| | | | |
|---|---|---|---|
| KR | 100977303 | B1 | 8/2010 |
| WO | 2013114135 | A1 | 8/2013 |
| WO | 2014032390 | A1 | 3/2014 |

* cited by examiner

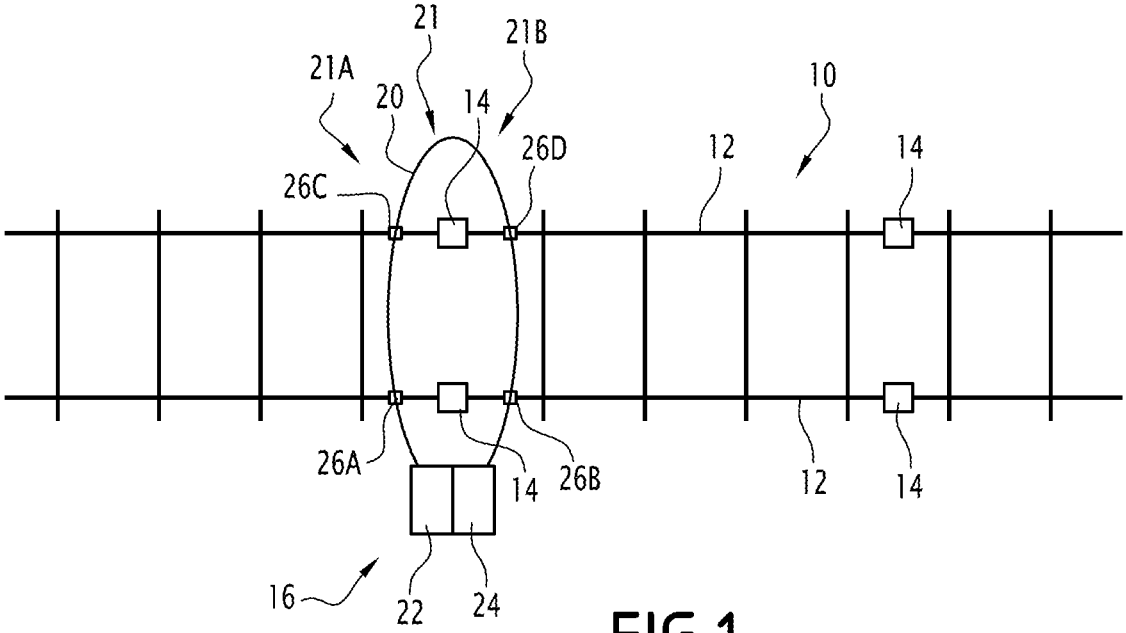
FIG.1
FIG.2
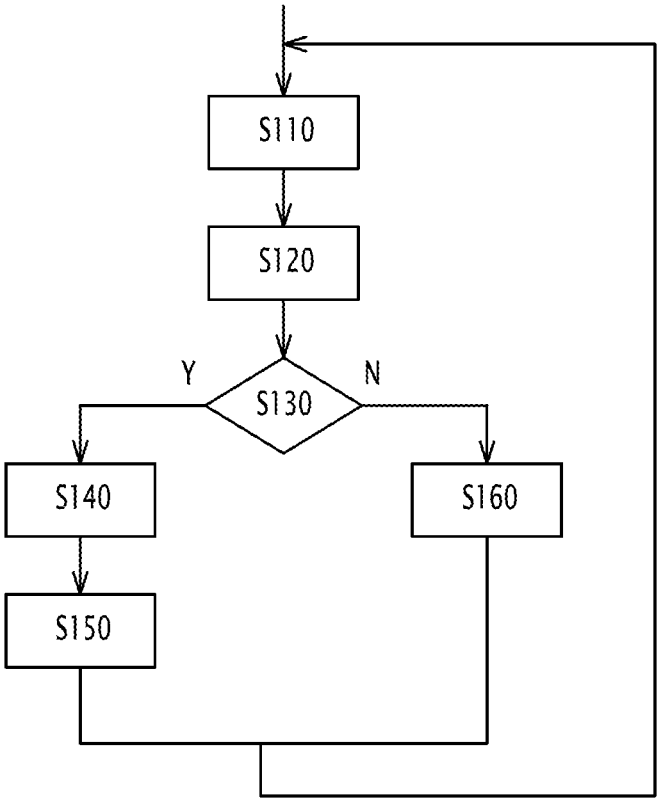

TRAIN DETECTION SYSTEM FOR A RAILWAY TRACK SECTION, ASSOCIATED RAILWAY TRACK SECTION, AND ASSOCIATED METHOD FOR DETECTING PRESENCE OF A RAILWAY VEHICLE ON A TRACK SECTION

FIELD OF THE INVENTION

The present disclosure relates to a train detection system for a railway track section.

Further, the present disclosure relates to a railway track section.

According to another aspect, the present disclosure concerns a detection method for detecting presence of a railway vehicle on a track section.

BACKGROUND OF THE INVENTION

In order to detect the presence of a railway vehicle on a track section, it is a well-known method to use axle counters. The axle counters use detection points installed at each end of a railway track section to count the passage of train axles. The detection points are physically connected to the rails and to a computer. The computer compares the count from the first end of the track section to the one from the second end of the track section: if these two counts are equal, the computer decides that no railway vehicle is present on that particular track section.

Yet this method is bulky and costly, as it requires installing relatively large detection points in contact with the rails, making it prone to error and subject to meteorological conditions. This method could be further impacted by magnetic interferences.

Another method of detecting trains on the track section consists of using track circuits. This method uses insulation joints to insulate track sections. An electric circuit is provided in each track section, and a signal relay detects whether there is an electric current in the track circuit. When a railway vehicle passes, its axle shorts out the electric circuit, and the absence of electric current triggers the signal relay to announce that a railway vehicle is present on this track section.

This method however implies other disadvantages. As it uses electric circuit, a wet weather can hamper its accuracy or even prevent it from detecting trains at all. It is also prone to error from for instance the insulated joint's failure to properly insulate two neighbouring track sections. This method could also be impacted by magnetic interferences.

As an improvement to the above-mentioned methods, it is known to use optical fibres buried right under the railway track for train detection. An example could be found in EP 1 128 171 A1.

Yet this method is not satisfactory either. Indeed, the arrangement of the optical fibre and its related detecting apparatuses is complicated. Moreover, signal processing required to determine whether a railway vehicle is present on the track section is often onerous.

SUMMARY OF THE INVENTION

According to an aspect, a train detection system is provided for a railway track section placed on a track bed, the track section having two rails, the train detection system comprising:

- at least one cable, the cable being placed across the two rails,

- a transmitter connected to the cable and configured to emit an emitted signal into the at least one cable,
- a receiver connected to the cable and configured to receive a received signal related to the emitted signal having passed through the cable, and capable of determining, according to the received signal, between an unoccupied state where no railway vehicle is present on the track section, and an occupied state where the track section is occupied by a railway vehicle, wherein the cable is buried under the track bed.

Embodiments may include one or more of the following features in any technical feasible combination:

- the cable forms a loop, and the transmitter and the receiver are located next to each other at a distance lower than 2 meters;
- the transmitter is configured to emit an electric signal and/or an optical signal;
- the cable is adapted so that the received signal is deteriorated or cut off when a railway vehicle is located above the cable;
- the receiver is configured to compare an amplitude of the received signal with a pre-determined threshold in order to determine whether a railway vehicle is present on the track section;
- the signal is a beam of light, the receiver being configured to determine that the track section is occupied by a railway vehicle when and only when the received optical signal is lower than the pre-determined threshold;
- the receiver is capable of calculating a travelling direction and/or a travelling velocity of the railway vehicle;
- the cable is an optical fibre;
- the train detection system comprises at least two sensors connected to the cable and configured to detect the presence of a vehicle and to send a signal to the receiver related to the presence or absence of a vehicle on the track section;
- the train detection system comprises a first sensor placed on a first half-loop of the loop where the first half-loop passes below a first rail of the track section, and a second sensor placed on a second half-loop of the loop where the second half-loop passes below a second rail of the track section; and
- each sensor comprises a photodetector.

According to another aspect, a railway track section is provided, the railway track section defining two ends and comprising:

- two rails,
- an insulated joint at each end of each rail, the insulated joints being configured to insulate electrically the railway track section from adjacent railway track sections, and
- a train detection system as disclosed above.

Embodiments may include the following feature:

- the cable forms a loop enclosing the insulated joint.

According to a further aspect, a detection method is provided for detecting presence of a railway vehicle on a railway track section, the railway track section being placed on a track bed and having two rails, the method comprising the following steps:

- emitting an emitted signal into at least one cable placed across the two rails and buried under the track bed,
- receiving a received signal related to the emitted signal having passed through the cable, and
- according to the received signal, determining between an unoccupied state where no railway vehicle is present on the track section, and an occupied state where the track section is occupied by a railway vehicle.

BRIEF DESCRIPTION OF THE DRAWINGS

The aforementioned advantages and features of the present disclosure will be better understood with reference to the following detailed description and the accompanying drawings in which:

FIG. 1 illustrates the layout of a railway track section according to the invention; and FIG. 2 is a flow chart of a detection method for detecting presence of a railway vehicle on the track section of FIG. 1.

DETAILED DESCRIPTION OF THE INVENTION

FIG. 1 illustrates a railway track section 10. The railway track section 10 is placed on a track bed (not illustrated on the Figures) and defines two ends.

The railway track section 10 comprises two rails 12 running parallel.

The railway track section 10 comprises also an insulated joint 14 at each end of each rail 12.

The insulated joints 14 are configured to electrically insulate the railway track section 10 from its neighbouring railway track sections 10. The insulated joints 14 are typically adapted for track circuits which detect the presence of railway vehicles on the track section 10. This is carried out in a well-known manner and will not be detailed here.

The railway track section 10 further comprises a train detection system 16.

The train detection system 16 comprises a cable 20, a transmitter 22, and a receiver 24.

Preferably, the train detection system 16 also comprises at least one sensor 26 placed on the cable 20 where the cable 20 passes below the rails 12.

Alternatively, the sensor is located on the track side or in a wayside bungalow.

As could be seen on FIG. 1, the cable 20 is placed across the two rails 12, i.e. the cable 20 is placed transversally to the rails 12, preferentially sensibly perpendicularly to the rails 12 and buried below the rails 12.

The cable 20 is buried under the track bed in the ballast. This layout could especially reduce the impact that minor disturbance may have on the track detection system 16, as will be explained below. The cable 20 is for example buried up to 4 metres below the rails 12.

The cable 20 consists preferably of an optical fibre capable of transmitting an optical signal. The optical fibre consists for instance of the optical fibre disclosed in DE 195 34 260.

The cable 20 forms here a loop 21 comprising a first half-loop 21A and a second half-loop 21B in the direction of the rails 12. The first half-loop 21A is placed upstream or downstream of the second half-loop 21B with regard to the elongation direction of the rails 12, so that a travelling railway vehicle first comes above one of the half-loops 21A, 21B before coming above the other half-loop 21B, 21A.

The loop 21 preferably encloses the insulated joints 14, as shown in FIG. 1.

The transmitter 22 is connected to the cable 20. The transmitter 22 is configured to emit an emitted signal into the cable 20.

Said emitted signal is an optical signal.

The receiver 24 is also connected to the cable 20. The receiver 24 is configured to receive a received signal consisting of the emitted signal passed through the cable 20.

The receiver 24 is capable of determining, according to the received signal, between an unoccupied state where no railway vehicle is present on the track section 10, and an occupied state where the track section 10 is occupied by a railway vehicle.

According to one embodiment of the invention, the cable 20 is adapted so that the received signal is corrupted when a railway vehicle is located above the cable 20, i.e. the track section 10 is occupied by a railway vehicle.

In this case, the receiver 24 is accordingly adapted to identify whether the received signal is corrupted and, when it is, to determine that the track section 10 is occupied by a railway vehicle.

According to another embodiment of the invention, the cable 20 is adapted so that the received signal is cut off from the receiver 24 when a railway vehicle is located above the cable 20, i.e. the track section 10 is occupied by a railway vehicle.

In this case, the receiver 24 is adapted to compare amplitude of the received signal with a pre-determined threshold and when the received signal falls below this pre-determined threshold, to determine that the track section 10 is occupied by a railway vehicle.

According to a preferred embodiment of the invention, the receiver 24 is also adapted to compare the amplitude of the received signal with a plurality of pre-determined thresholds to acquire more details regarding the occupancy of the track section 10. For instance, two pre-determined thresholds T1, T2 (T1>T2) exist; if the amplitude of the received signal is above T1, the receiver 24 determines that no railway vehicle occupies the track section 10; if the amplitude of the received signal is lower than T2, the receiver 24 determines that there is a normal railway vehicle on the track section 10; and if the amplitude of the received signal falls between T1 and T2, the receiver 24 determines that a road-rail vehicle or a lighter railway vehicle is located on the track section 10.

According to a specific embodiment of the invention, the receiver 24 is configured to determine that the track section 10 is occupied by a railway vehicle when and only when the received optical signal is lower than the pre-determined threshold, without any additional steps of analysis. This allows a simpler analysis of the received signal without having to carry out further analyses. This also avoids observing the backscattering of light in the optical fibres.

Said additional steps for example include compensating and normalising the signal received by the receiver 24.

According to another embodiment of the invention, the receiver 24 is configured to compare the difference of amplitude between the amplitude of the received signal and the amplitude of the emitted signal with a pre-determined amplitude variation and to determine that the track section 10 is occupied by a railway vehicle when the difference of amplitude exceeds said pre-determined amplitude variation.

The transmitter 22 and the receiver 24 are located next to each other at a distance lower than 2 meters, preferably at the same location, for example at a wayside control point. This enables a simpler management of the transmitter 22 and the receiver 24, and a more centralised protection against elements. The transmitter 22 and the receiver 24 are preferably buried under the track bed, for example buried up to 4 metres below the rails 12.

As a variant, the train detection system 16 also comprises a plurality of redundant transmitters 22 and receivers 24 connected to the cable 20 to ensure that the transmitters 22 and the receivers 24 are failsafe.

Advantageously, the receiver 24 comprises a calculation unit capable of determining between an unoccupied state where no railway vehicle is present on the track section 10, and an occupied state where the track section 10 is occupied by a railway vehicle.

Alternatively, the train detection system 16 comprises sensors 26 configured to detect the presence of a vehicle and to send a signal to the receiver 24 related to the presence or absence of a vehicle on the track section 10. Advantageously each sensor 26 is associated to the cable 20.

For example, according to a preferred embodiment, the train detection system 16 comprises two sensors 26. A first sensor 26A is placed on the first half-loop 21A where the first half-loop 21A passes below one of the rails 12, and a second sensor 26B is placed on the second half-loop 21B where the second half-loop 21B passes below one of the rails 12. According to a more preferred embodiment which is represented on FIG. 2, the train detection system 16 comprises four sensors 26. A first sensor 26A is placed on the first half-loop 21A where the first half-loop 21A passes below a first rail 12, a second sensor 26B is placed on the second half-loop 21B where the second half-loop 21B passes below the first rail 12, a third sensor 26C is placed on the first half-loop 21A where the first half-loop 21A passes below a second rail 12, and a fourth sensor 26D is placed on the second half-loop 21B where the second half-loop 21B passes below the second rail 12.

Each sensor 26 comprises for example a photodetector connected to two independent channels, each channel comprising independent components configured to process the output signal of the photodetector.

Advantageously each channel is connected to the calculation unit of the receiver 24 which determines according to the signals it receives whether the track section 10 is occupied or not by a railway vehicle. In this embodiment the receiver 24 is for instance not connected to the cable 20.

Advantageously each sensor 26 comprises a piece of specific fibre, associated with a photodetector and connected to regular optical fibres 20 to form the optical fibre loop 21.

According to an embodiment of the invention, each sensor 26A, 26B, 26C, 26D is connected to the receiver 24 via the optical fibre 20.

Advantageously, the receiver 24 is also capable of calculating a travelling direction and/or a travelling velocity of the railway vehicle, as it will be explained below.

As a variant, instead of an optical fibre, the cable 20 consists of an electric cable connected to the transmitter 22 and the receiver 24.

In this case, the transmitter 22 is configured to emit an electrical signal into the electric cable, and the electric cable is capable of transmitting this electric signal into the receiver 24.

The electric signal is for example a digital logic signal.

The receiver 24 is then adapted to identify whether the received signal is corrupted. This embodiment applies in particular when the emitted signal is an electric signal comprising a string of repetitive signals in a manner that the electric signal bears a distinctive signature. The electric signal is for example RP 2000, or a rectangular signal, or a waveform. The received signal is then regarded as corrupted when the signature is corrupted, i.e. if the received signal does not comprise the distinctive signature, i.e. does not correspond to a string of repetitive signals. For example, the received signal is compared with a signal corresponding to the string of repetitive signals. The receiver 24 is then adapted to determine that the track section 10 is occupied by a railway vehicle when and only when the received signal is corrupted.

Alternatively, the receiver 24 is adapted to identify whether the received signal is cut off, and to determine that the track section 10 is occupied by a railway vehicle when and only when the received signal is cut off. Identification of whether the received signal is cut off is preferably performed as described above in the first embodiment.

Alternatively, the train detection system 16 comprises also sensors 26A, 26B, 26C, 26D connected to the electric cable, each sensor 26A, 26B, 26C, 26D being adapted to identify whether the received signal is corrupted/deteriorated.

A detection method for detecting presence of a railway vehicle on the track section 10 will now be described with reference to FIG. 2.

Before the detection can take place, a train detection system 16 as disclosed above is put in place to provide necessary infrastructure for train detection. The cable 20 is placed across the rails 12 and buried under the track bed.

Initially, as represented by S110 in FIG. 2, the transmitter 22 emits an emitted signal into the cable 20.

Then, as represented by S120 in FIG. 2, the emitted signal passes through the cable 20. The receiver 24 receives a received signal related to the emitted signal having passed through the cable 20.

Afterwards, as indicated by the S130, the receiver 24 checks whether the received signal is corrupted or cut off. During this step S130, the receiver 24 compares for instance the amplitude of the received signal with a pre-determined threshold and checks whether the received signal falls below this pre-determined threshold. This comparison is preferably carried out without additional steps, for example compensating and normalising the signal received by the receiver 24. Alternatively, the receiver 24 compares during step S130 the difference of amplitude between the amplitude of the received signal and the amplitude of the emitted signal with a pre-determined amplitude variation. For example, the receiver 24 compares the amplitude of each signal received from each sensor 26 with the predetermined threshold.

If the reply from S130 is affirmative, the receiver 24 determines during a step S140 that the track section 10 is in an occupied state, i.e. is occupied by a railway vehicle.

Preferably, after step S140 the detection method also comprises a step S150 of analysing the received signal to determine a travelling direction and a travelling velocity of the railway vehicle.

During this step S150, the receiver 24 receives signals from the first and second sensor 26A, 26B. If the signal indicating the presence of the railway vehicle above the first sensor 26A precedes the signal indicating the presence of the railway vehicle above the second sensor 26B, the receiver 24 determines that the railway vehicle travels from the first half-loop 21A to the second half-loop 21B, i.e. from left to right on the FIG. 2. In contrast, if the signal indicating the presence of the railway vehicle above the first sensor 26A lags behind the signal indicating the presence of the railway vehicle above the second sensor 26B, the receiver 24 determines that the railway vehicle travels from the second half-loop 21A to the first half-loop 21A, i.e. from right to left on the FIG. 2.

Advantageously, the receiver 24 compares the amount of light received between the two sensors 26A, 26B which are connected to the receiver 24 through respective inputs of the receiver 24, in order to determine the direction of travel of the railway vehicle.

Furthermore, the receiver 24 determines the travelling velocity of the railway vehicle by measuring the delay in signals indicating presence of a railway vehicle between the first sensor 26A and the second sensor 26B. As the distance between the first and second sensors 26A, 26B is known beforehand, the travelling velocity of the railway vehicle can be subsequently calculated.

The third and fourth sensor 26C, 26D provides respectively backup for the first and second sensor 26A, 26B so that in the event of the failure of the first and second sensors 26A, 26B, the train detection systems 16 remains capable of detecting the travelling direction and/or the travelling velocity of the railway vehicle. Also, they can be used to verify the travelling direction and/or the travelling velocity calculated from the signals of the first and second sensors 26A, 26B.

Alternatively, during the step S140, only one of the travelling direction and travelling velocity of the railway vehicle is determined.

If, in contrast, the reply from S130 is negative, step S130 is followed by a step S160 in which the receiver 24 then determines that the track section 10 is in an unoccupied state, i.e. no railway vehicle is present on the track section 10.

After the determination either by S140 or S160, the method returns to step S110 to continue detecting the presence of railway vehicles on the track section 10.

Thanks to the invention disclosed above, the train detection on a track section 10 is significantly simplified without compromising its precision. More precisely, by burying the cable 20 under the track bed, the train detection system 16 becomes largely immune to minor disturbances originating from train occupancy on neighbouring track sections 10. Only when the railway vehicle actually occupies the particular track section 10 under study will the receiver 24 signal that this track section 10 is occupied.

Moreover, by burying the cable 20 under the track bed, the cable 20 is no longer subject to high pressure directly applied by the rail 12. This exempts the necessity to apply a pre-load filter, which was required in EP 1 128 171 and lead to inaccuracy in the vicinity of zero point.

In addition, simple analysis of the received signal without complicated data processing reduces the time and cost required for detecting the presence of a railway vehicle on the track section 10.

The invention claimed is:

1. A train detection system for a railway track section placed on a track bed, the track section having two rails, the train detection system comprising:

at least one cable, the cable being placed across the two rails, a transmitter connected to the cable and configured to emit an emitted signal into the at least one cable, a receiver connected to the cable and configured to receive a received signal related to the emitted signal having passed through the cable, and capable of determining, according to the received signal, between an unoccupied state where no railway vehicle is present on the track section, and an occupied state where the track section is occupied by a railway vehicle, wherein the cable is buried under the track bed.

2. The train detection system according to claim 1, wherein the cable forms a loop, and the transmitter and the receiver are located next to each other at a distance lower than 2 meters.

3. The train detection system according to claim 1, wherein the transmitter is configured to emit an electric signal and/or an optical signal.

4. The train detection system according to claim 1, wherein the cable is adapted so that the received signal is deteriorated or cut off when a railway vehicle is located above the cable.

5. The train detection system according to claim 1, wherein the receiver is configured to compare an amplitude of the received signal with a pre-determined threshold in order to determine whether a railway vehicle is present on the track section.

6. The train detection system according to claim 5, wherein the signal is a beam of light, the receiver being configured to determine that the track section is occupied by a railway vehicle when and only when the received optical signal is lower than the pre-determined threshold.

7. The train detection system according to claim 1, wherein the receiver is configured to calculate a travelling direction and/or a travelling velocity of the railway vehicle.

8. The train detection system according to claim 1, wherein the cable is an optical fibre.

9. The train detection system according to claim 1, wherein the train detection system comprises at least two sensors connected to the cable and configured to detect the presence of a vehicle and to send a signal to the receiver related to the presence or absence of a vehicle on the track section.

10. The train detection system according to claim 2, wherein the train detection system comprises a first sensor placed on a first half-loop of the loop where the first half-loop passes below a first rail of the track section, and a second sensor placed on a second half-loop of the loop where the second half-loop passes below a second rail of the track section.

11. The train detection system according to claim 9, wherein each sensor comprises a photodetector.

12. A railway track section defining two ends and comprising:

two rails, an insulated joint at each end of each rail, the insulated joints being configured to insulate electrically the railway track section from adjacent railway track sections, and a train detection system according to claim 1.

13. The railway track section according to claim 12, wherein the cable forms a loop enclosing the insulated joint.

14. A detection method for detecting presence of a railway vehicle on a railway track section, the railway track section being placed on a track bed and having two rails, the method comprising the following steps:

emitting an emitted signal into at least one cable placed across the two rails and buried under the track bed, receiving a received signal related to the emitted signal having passed through the cable, and according to the received signal, determining between an unoccupied state where no railway vehicle is present on the track section, and an occupied state where the track section is occupied by a railway vehicle.

15. A train detection system for a railway track section placed on a track bed, the track section having two rails, the train detection system comprising:

at least one cable, the cable being placed across the two rails, a transmitter connected to the cable and configured to emit an emitted signal into the at least one cable, a receiver connected to the cable and configured to receive a received signal related to the emitted signal having passed through the cable, and capable of determining, according to the received signal, between an unoccupied state where no railway vehicle is present on the track section, and an occupied state where the track section is occupied by a railway vehicle, wherein the cable is buried under the track bed, and wherein the cable is an optical fibre.

* * * * *